United States Patent [19]

Black

[11] 4,258,625

[45] Mar. 31, 1981

[54] BALL-ACTUATED TUBULAR PROJECTILE

[76] Inventor: William L. Black, 1802-B Withington, China Lake, Calif. 93555

[21] Appl. No.: 37,202

[22] Filed: May 8, 1979

[51] Int. Cl.[3] ..... F42B 11/00

[52] U.S. Cl. ..... 102/92.1; 102/DIG. 10

[58] Field of Search ..... 102/DIG. 10, 92.1–92.7, 102/244, 245

[56] References Cited

U.S. PATENT DOCUMENTS

| | | | |
|---|---|---|---|
| 636,485 | 11/1899 | Brown | 102/DIG. 10 |
| 1,899,618 | 2/1933 | Holthe | 102/DIG. 10 |
| 3,136,253 | 6/1964 | Kulesza et al. | 102/244 |
| 3,211,099 | 10/1965 | Popovitch | 102/244 |
| 3,672,301 | 6/1972 | Abbott | 102/43 C |
| 4,029,017 | 6/1977 | Hubsch et al. | 102/43 C |

FOREIGN PATENT DOCUMENTS

| | | | |
|---|---|---|---|
| 470648 | 5/1969 | Switzerland | 102/DIG. 10 |

*Primary Examiner*—Harold J. Tudor

*Attorney, Agent, or Firm*—R. S. Sciascia; W. Thom Skeer

[57] ABSTRACT

A spin-velocity actuated ball valve in a hollow-nose, hollow base projectile is positioned to selectively close or open a projectile. In the closed position normal propellant pressure or projectile carried propellant causes the projectile to achieve operational velocity. In the open position a conduit through the projectile reduces frontal area and tail drag caused by turbulence.

15 Claims, 4 Drawing Figures

BALL-ACTUATED TUBULAR PROJECTILE

BACKGROUND OF THE INVENTION

1. Field of the Invention

This invention relates to projectiles. More particularly, this relates to high speed ballistic projectiles. By way of further characterization, this invention relates to the class of projectiles known as tubular projectiles. By way of further characterization, this invention pertains to a high speed tubular projectile which may be fired without the use of a sabot.

2. Description of the Prior Art

Ballistic projectiles comprise a very old segment of the armament arts and the study of such weapons has involved a long history of analysis and experimentation. The study of the ballistic flight of the projectile, known as exterior ballistics, shows that a major limiting factor of the projectiles efficiency in transferring the energy of flight is that of ballistic drag. The major cause of ballistic drag is the base drag or turbulence following the projectile in flight. One promising form of projectile which diminishes this ballistic drag is the tubular projectile. In this class of projectile a longitudinal bore extending through the projectile permits the gas of the atmosphere to pass therethrough and diminish the turbulence of the base of the projectile. Additionally, it has been shown that the tubular projectile has certain advantages in target penetration.

In order to prevent the propellant which provides the mode of power for the projectile from passing through the central aperture, tubular projectiles, in the past, have incorporated and encasing sabot to contain this pressure until the projectile has cleared the muzzle of the launching mechanism. The sabot then falls away and the projectile proceeds on its intended ballistic path. Although satisfactory for some purposes, the sabot launched projectile suffers from certain disadvantages. The loss of the sabot and its mass diminishes the kinetic energy that the projectile delivers to the target and the sabot impacts areas other than the target. Further, the separation of the sabot and projectile is not uniform and therefore adversely affects the ballistic path. Additionally, the sabot-fired tubular projectile has difficulties in firing from an aerial platform in that the sabot may be ingested by the engine of the launching airframe. Because of these, and other, considerations, the sabot launched tubular projectile has failed to gain satisfactory exploitation.

SUMMARY OF THE INVENTION

The present invention employs a tubular projectile with a valve located in the longitudinal passage of the tubular projectile which is closed to prevent gas flow therethrough during initial launch or firing and opens when the projectile is airborne to permit the gas flow through the central aperture. Thus, the mass of the valve remains an integral portion of the projectile and no sabot is required to fire and launch the projectile. Further, the design lends itself to enclosing a propellant charge to give a propulsion boost to the projectile in addition to the propellant in the cartridge case.

Accordingly, it is the object of this invention to provide an improved projectile.

A further object of this invention is to provide a tubular projectile having a high velocity.

Another object of this invention is to provide a high velocity tubular projectile which may be launched without a sabot.

A still further object of this invention is the provision of a tubular projectile which may be fired from aircraft.

Another object of the invention is the provision of a projectile which may be safely fired over friendly forces.

These and other objects and advantages will become apparent and understood with reference to the following detailed description, figures, and claims.

DESCRIPTION OF THE PREFERRED EMBODIMENT

Figure 1:
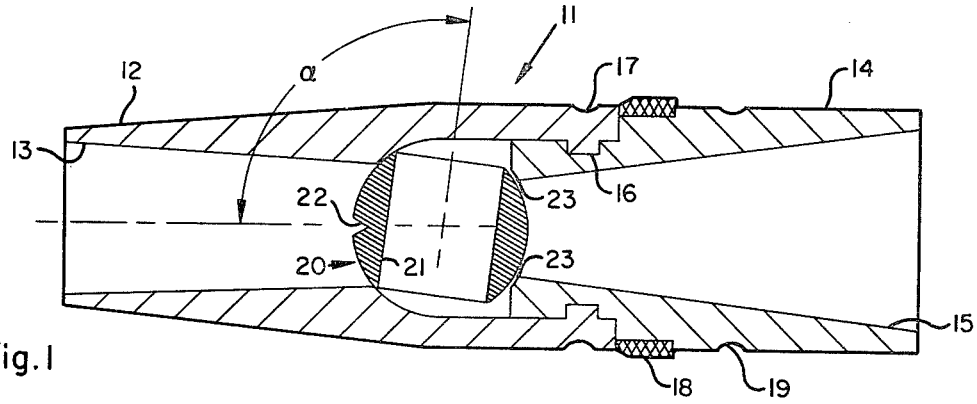
FIG. 1 is a longitudinal sectional view of a projectile according to the invention.

Referring to FIG. 1, a projectile is illustrated generally at 11. As shown, projectile 11 has a nose portion 12 having a longitudinal bore 13 extending therethrough.

A base portion of projectile 11 is illustrated at 14. Base portion 14 has a longitudinal bore 15 extending therethrough. Base portion 14 is shouldered to telescopically receive nose portion 12 and has a circumferentially extending groove 16 into which nose portion 12 is cold-rolled during assembly. This cold-rolling produces an external cannelure 17. A rotational band 18 is also carried by base portion 14 and serves the conventional function of engaging the rifling lands in the launching barrel. Base portion 14 also carries a cannelure 19 on its outer surface for engagement by the cartridge case, not shown. Bores 13 and 15 are conical with their apexes innermost. A valve seat is machined in nose portion 12 and base portion 14.

A spherical ball valve 20 is carried on the seat within projectile 11 and is configured to close the passage formed by bore 13 and 15 when the cartridge is at rest, prior to firing. Valve 20 has an internal bore 21 of a diameter chosen to mate with bores 13 and 15 in the nose and base portions of projectile 11, respectively. The outer surface of valve 20 carries an indexing indentation 22 which is used in assembling projectile 11, as will be described. A small amount of cement 23 holds valve 20 in the illustrated closed position during handling of the complete projectile prior to firing. Cement 23 additionally provides a hermetic seal to prevent moisture in the ambient air from entering the propellant space within the cartridge case.

In operation, the projectile is fired in a conventional fashion and, because of engaging band 18 cooperatively tracking the lands within the rifle barrel, projectile 11 is set into a spinning motion as it exits the barrel. Of course, such longitudinal spin is common in the ballistic projectile arts and need not be described in greater detail.

Because valve 20 has the axis of bore 21 slightly displaced by an angle $\alpha$ from the longitudinal axis of projectile 11, the valve is caused to move to a centrifugally stable position such that bore 21 is brought into alignment with passages 13 and 15. This alignment is made possible when the forces of the spherical annulus of valve 20 have exceeded the restraining force provided by cement 23.

If desired, cement 23 may be of a type which is weakened with increase of temperature such that the heat generated by the propellant burning during launch causes the cement to weaken such that the rotational forces are able to overcome its restraining action.

When passage 21 is aligned with bores 13 and 15, the air entering bore 13 exits base portion 14 through bore 15 to effectively diminish turbulance at the base of the projectile.

Figure 2:
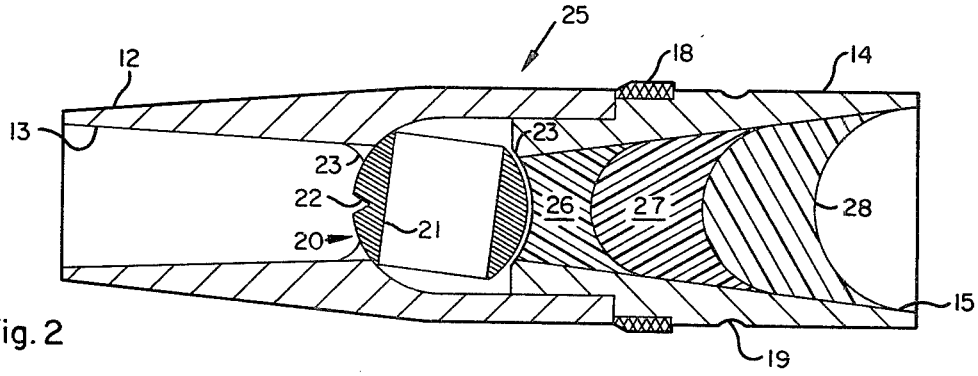
FIG. 2 is a longitudinal sectional view of a projectile according to the invention employing a propellant booster.

Referring to FIG. 2, a variation of the projectile of FIG. 1 is illustrated generally at 25. In this illustration, like numbers denote similar components as illustrated in FIG. 1. It will be observed that nose portion 12 is joined to base portion 14 by either welding or a cement bond, not shown, rather than the roll-crimp method illustrated in FIG. 1. Such methods of joining nose portion 12 to base portion 14 are conventional in the projectile arts and the choice as between various conventional techniques depends upon the technological tradeoffs familiar to those versed in projectile design.

A more significant difference in the projectiles of FIG. 1 and FIG. 2 resides in the use of a propellant booster carried by base portion 14 in the design of FIG. 2. As illustrated, the propellant may be placed within passage 15 in three separate grains indicated at 26, 27, and 28. These propellants may be chosen with different burning rates in order to provide optimum propellant assisted trajectories. The use of such propellants is well understood in the art and need not be explained in greater detail here. However, it should be noted that in such an arrangement, cement bond 23 may be extended across the entire aft surface of valve 20 such as to be in contact with propellant grain 26.

Figure 3:
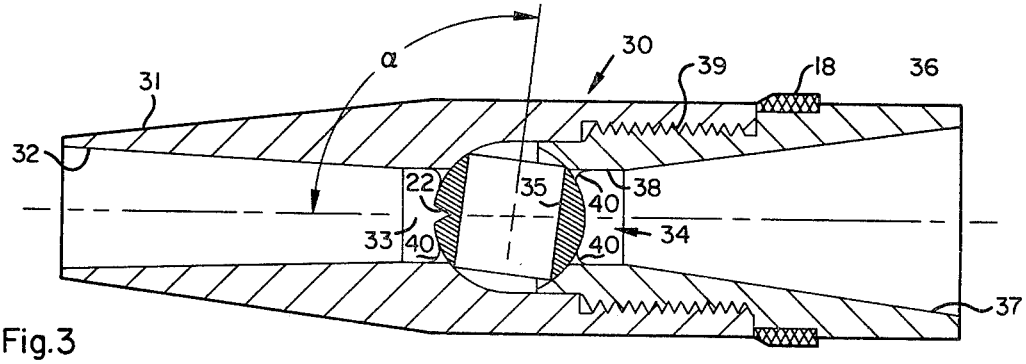
FIG. 3 is a longitudinal sectional view of a projectile according to the invention showing the use of threaded connectors to assemble the major components thereof.

Referring to FIG. 3, another variation of applicants projectile is illustrated at 30. As in FIG. 1, a nose portion 31 has a tapered conical bore 32 extending longitudinally therethrough and communicating with a cylindrical passage indicated at 33. Valve 34 has a cylindrical passage 35 of the same diameter as passage 33. An exterior detent 22 serves the same purpose as detent 22 in the embodiments of FIGS. 1 and 2 to align valve 34 at an angular offset indicated at $\alpha$ from the longitudinal axes of projectile 30. A base portion 36 has a conical passage 37 extending from the exterior base to a cylindrical passage 38 which is of the same diameter as passage 33 and valve passage 35. Base portion 36 is secured to nose portion 31 by means of mated threads 39, as is conventional in the projectile fabrication arts. As previously described, valve 34 as held against accidental rotation prior to firing by means of a cement bond 40 which may be placed on both the forward and aft ends of valve 34. As previously noted, this cement provides both means for positioning valve 34 and hermetic protection for propellant which is in the cartridge fixed to the aft end of projectile 30.

Figure 4:
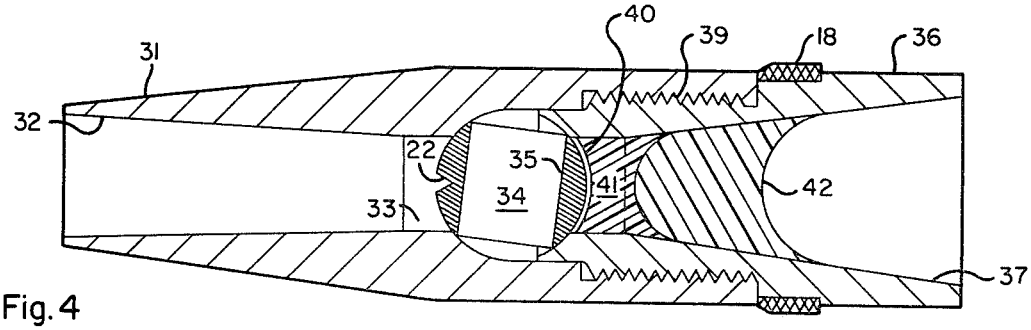
FIG. 4 is a longitudinal sectional view of the threaded form of the invention showing a booster propellant.

Referring to FIG. 4, another embodiment of the projectile shown in FIG. 3 houses a propellant charge 41 and 42 in a fashion similar to that illustrated in FIG. 2. It will be observed that in the species of FIG. 4 only two grains of propellant 41 and 42 are used as compared to the three grains used in FIG. 2. Thus, the amount and type of propellant may be varied with the conventional tradeoffs expected of different propellants and burning rates thereof.

Aside from the different velocity boost provided by the propellant charges in the species of the invention employing projectile carried propellants, the propellant grains provide additional valve positioning means and hermetic seal for protection of the propellant confined within the supporting cartridge case, not shown.

The projectiles of all of the figures may be fabricated from conventional material such as steel, for example. Likewise, although illustrated as having uniform composition through both the nose portion, base portion, and valve, the projectile may be made by using a core metal with plating or cladding covering the outer surfaces. Such fabrication techniques are common in the projectile arts. Additional projectile weight may be obtained by using conventional techniques and heavier materials such as derived from spent reactor cores. The machined parts are assembled by conventional techniques with the exception that the valve is fitted in the obturation position by an alignment fixture, not shown cooperating with detent 22 and the nose portion of the projectile. Of course, if desired, other positioning arrangements might be employed.

The nose portion is then joined to the base portion by conventional techniques such as rolling, FIG. 1, welding, FIG. 2, or threading, FIG. 3, with the ball held in place by the alignment fixture, a cement bond 23 or 40 is applied to stabilized at the valve in the closed position.

The angle $\alpha$ is chosen to provide sufficient eccentric mass to insure that the valve will overcome the adhesive bond and move to the open position after a short distance of flight.

The precise reaction of the ball valve to pressures during the internal ballistics portion is uncertain. That is, it is not clear by what mechanism the valve overcomes the inertial or cement restraint to move to the open position. It is hypothesized that either sufficient rotational force is derived because of the angular offset $\alpha$, which may be between 95° and 105°, or that the rotation of the projectile nose and base portion caused by engagement of the rifling by band 18 sufficiently breaks any cement seal such that the projectile actually rotates longitudinally about the ball and transfers momentum thereto by frictional engagement. However, experience has shown that regardless of which of these forces are in play, valve actuation may be uniformly established by constructional variations.

The shape of the projectile of FIGS. 1–4 is exemplary of many external configurations that might be used in the practice of the invention. That shown provides a good weight-to-length ratio.

In use, the projectile is dimensioned to be loaded in conventional fixed ammunition cases and handled in a conventional firearms system. The projectile of the invention improves this systems operation by providing shorter projectile flight times and increased velocities such as to make marked improvements in the overall performance of the weapons system.

The foregoing description taken together with the appended claims constitute a disclosure such as to enable the person skilled in the ammunition and firearms arts and having the benefit of the teachings contained therein to make and use the invention. Further, the structure herein described meets the objects of invention, and generally constitutes a meritorious advance in the art unobvious to such a worker not having the benefit of these teachings.

What is claimed is:

1. A projectile comprising:

a tubular body dimensioned to interact with a gun barrel to produce projectile spin and having a nose portion and a base portion and a longitudinally extending passage extending therethrough connecting said nose and base portions so as to permit gas flow through said passage as well as around said tubular body, and spherical ball valve means mounted within said longitudinally extending passage between said nose and base portions and movably contained therein for selectively controlling said gas flow in response to the spin of said projectile.

2. A projectile according to claim 1 wherein said longitudinally extending passage tapers inwardly from said nose and base portions.

3. A projectile according to claim 1 wherein said nose and base portions are telescopically fitted together.

4. A projectile according to claim 1 wherein said spherical ball valve means comprises an apertured sphere.

5. A projectile according to claim 4 in which said apertured sphere is held in a fixed position with the aperture thereof out of communication with said longitudinally extending passage to form a obturation thereof.

6. A projectile according to claim 5 wherein the aforesaid nose and base portions are telescopically fitted together.

7. A projectile according to claim 5 wherein the aforesaid longitudinally extending passage is configured to include two surfaces tapering inwardly from said nose and base portions.

8. A projectile according to claim 1 further including a propellant carried with said passage and in the base portion of said projectile.

9. A projectile according to claim 5 further including a propellant contained within said base portion and afixed to said apertured sphere.

10. A projectile comprising:

a body extending circumferentially about a longitudinal axis dimensioned to interact with a gun barrel to produce projectile spin and having a nose and a base on opposite ends thereof and an outer surface;

an inner surface defining a void within said body and extending along said nose and said base thereby providing a passage therethrough; and substantially spherical ball valve means positioned within said void to be supported and carried within said body and movable in response to the spin of said projectile between first and second positions for controlling gas flow through said passage.

11. A projectile according to claim 10 wherein said obturator means further includes a hermetic seal.

12. A projectile according to claim 10 wherein said obturator means includes a propellant.

13. A projectile according to claim 10 wherein said obturator means includes an apertured spherical valve.

14. A projectile according to claim 13 wherein said apertured spherical valve is held against rotation by a releasable agent.

15. A projectile according to claim 13 wherein said apertured spherical valve is positioned to have the apertured valve asymetrically positioned with respect to said longitudinal axis.

* * * * *